US009200761B2

(12) United States Patent
Hong et al.

(10) Patent No.: US 9,200,761 B2
(45) Date of Patent: Dec. 1, 2015

(54) LIGHTING DEVICE FOR INDIRECT ILLUMINATION

(71) Applicant: LG INNOTEK CO., LTD., Seoul (KR)

(72) Inventors: Sungho Hong, Seoul (KR); Seok Jin Kang, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 159 days.

(21) Appl. No.: 14/049,015

(22) Filed: Oct. 8, 2013

(65) Prior Publication Data

US 2014/0036509 A1 Feb. 6, 2014

Related U.S. Application Data

(63) Continuation of application No. 12/939,559, filed on Nov. 4, 2010, now Pat. No. 8,573,802.

(30) Foreign Application Priority Data

Nov. 9, 2009 (KR) ..... 10-2009-0107487
Nov. 9, 2009 (KR) ..... 10-2009-0107489
Nov. 9, 2009 (KR) ..... 10-2009-0107492

(51) Int. Cl.

| | |
|---|---|
| ***F21V 7/10*** | (2006.01) |
| ***F21K 99/00*** | (2010.01) |
| ***F21V 7/00*** | (2006.01) |
| ***F21V 29/00*** | (2015.01) |
| ***F21V 29/77*** | (2015.01) |

(Continued)

(52) U.S. Cl.

CPC ..... *F21K 9/50* (2013.01); *F21V 7/0008* (2013.01); *F21V 7/0041* (2013.01); *F21V 29/004* (2013.01); *F21V 29/773* (2015.01); *F21S 8/04* (2013.01); *F21V 7/22* (2013.01); *F21Y 2101/02* (2013.01); *F21Y 2103/022* (2013.01)

(58) Field of Classification Search

CPC ... F21V 7/0025; F21V 7/0033; F21V 7/0041; F21V 7/0083

See application file for complete search history.

(56) References Cited

U.S. PATENT DOCUMENTS 3,536,905 A * 10/1970 Ruff et al. ..... 362/1
4,591,960 A 5/1986 Jones (Continued)

FOREIGN PATENT DOCUMENTS

DE 296 20 583 U1 3/1997
JP 05-081913 4/1993

(Continued)

OTHER PUBLICATIONS

European Search Report issued in Application No. 15151194.6 dated May 11, 2015.

(Continued)

*Primary Examiner* — Ismael Negron
(74) *Attorney, Agent, or Firm* — Ked & Associates, LLP

(57) ABSTRACT

The lighting device including a reflector; a heat radiating body having a wall disposed around the reflective part of the reflector; a light emitter including a substrate disposed on a bottom surface of the wall of the heat radiating body and a plurality of light emitting devices disposed on the substrate; and a cover including a reflective surface disposed under the bottom surface and reflecting a first light from the light emitting devices to the reflective part of the reflector, and having an opening emitting a second light from the reflective part of the reflector to outside.

20 Claims, 7 Drawing Sheets

(51) Int. Cl.

| | |
|---|---|
| *F21S 8/04* | (2006.01) |
| *F21Y 101/02* | (2006.01) |
| *F21Y 103/02* | (2006.01) |
| *F21V 7/22* | (2006.01) |

(56) References Cited

U.S. PATENT DOCUMENTS

| | | | | |
|---|---|---|---|---|
| 4,755,916 | A * | 7/1988 | Collins | 362/236 |
| 5,136,483 | A | 8/1992 | Schöniger et al. | |
| 5,285,356 | A * | 2/1994 | Skene et al. | 362/1 |
| 5,488,550 | A | 1/1996 | Yang | |
| 5,564,065 | A | 10/1996 | Fleck et al. | |
| 6,149,283 | A * | 11/2000 | Conway et al. | 362/236 |
| 6,550,942 | B1 | 4/2003 | Zou et al. | |
| 6,655,813 | B1 | 12/2003 | Ng | |
| 7,055,991 | B2 * | 6/2006 | Lin | 362/311.02 |
| 7,192,164 | B2 | 3/2007 | Matsuura | |
| 7,229,198 | B2 * | 6/2007 | Sakai et al. | 362/560 |
| 7,246,917 | B2 | 7/2007 | Rhoads et al. | |
| 7,275,841 | B2 | 10/2007 | Kelly | |
| 7,559,664 | B1 | 7/2009 | Walleman et al. | |
| RE40,934 | E | 10/2009 | Ruud et al. | |
| 7,722,220 | B2 * | 5/2010 | Van De Ven | 362/294 |
| 7,963,666 | B2 | 6/2011 | Leung et al. | |
| 8,028,537 | B2 | 10/2011 | Hanley et al. | |
| 8,083,379 | B2 | 12/2011 | Schulz et al. | |
| 8,104,923 | B2 | 1/2012 | Nagai | |
| 8,142,057 | B2 | 3/2012 | Roos et al. | |
| 8,348,459 | B2 * | 1/2013 | Jacobi | 362/241 |
| 8,814,417 | B2 * | 8/2014 | Ko et al. | 362/612 |
| 2002/0114158 | A1 | 8/2002 | Chuang | |
| 2008/0037255 | A1 | 2/2008 | Wang | |
| 2008/0123338 | A1 | 5/2008 | Kokado | |
| 2008/0144328 | A1 | 6/2008 | Yagi et al. | |
| 2008/0198572 | A1 | 8/2008 | Medendorp | |
| 2009/0003009 | A1 | 1/2009 | Tessnow et al. | |
| 2009/0067186 | A1 | 3/2009 | Futami | |
| 2009/0161356 | A1 | 6/2009 | Negley et al. | |
| 2009/0237923 | A1 | 9/2009 | Zheng | |
| 2009/0243455 | A1 | 10/2009 | Biebel et al. | |
| 2009/0251884 | A1 | 10/2009 | Rains | |
| 2009/0310359 | A1 | 12/2009 | Hsiao et al. | |
| 2011/0033346 | A1 | 2/2011 | Bohlen et al. | |

FOREIGN PATENT DOCUMENTS

| | | | |
|---|---|---|---|
| JP | 2006-179658 | | 7/2006 |
| KR | 10-2009-0046120 | A | 5/2009 |
| KR | 10-2009-0066262 | A | 6/2009 |
| WO | WO 00/34709 | A1 | 6/2000 |
| WO | WO 2008/031405 | | 3/2008 |

OTHER PUBLICATIONS

Chinese Office Action dated Sep. 26, 2012 with English Translation.
European Search Report dated Dec. 4, 2012 issued in Application No. 10 18 8261.
U.S. Office Action for U.S. Appl. No. 12/939,559 dated Jun. 22, 2011.
U.S. Office Action for U.S. Appl. No. 12/939,559 dated Sep. 23, 2011.
U.S. Office Action for U.S. Appl. No. 12/939,559 dated Apr. 3, 2012.
U.S. Office Action for U.S. Appl. No. 12/939,559 dated Aug. 22, 2012.
U.S. Office Action for U.S. Appl. No. 12/939,559 dated Apr. 9, 2013.

* cited by examiner

LIGHTING DEVICE FOR INDIRECT ILLUMINATION

CROSS-REFERENCE TO RELATED APPLICATION

This application is a Continuation Application of U.S. application Ser. No. 12/939,559 filed Nov. 4, 2010, which claims priority from Korean Application No. 10-2009-0107487, filed Nov. 9, 2009, No. 10-2009-0107489, filed Nov. 9, 2009, No. 10-2009-0107492, filed Nov. 9, 2009, the subject matters of which are incorporated herein by reference

BACKGROUND

1. Field

This embodiment relates to a lighting device.

2. Background

A light emitting diode (hereinafter, referred to as LED) is a semiconductor element for converting electric energy into light. As compared with existing light sources such as a fluorescent lamp and an incandescent electric lamp and so on, the LED has advantages of low power consumption, a semi-permanent span of life, a rapid response speed, safety and an environment-friendliness. For this reason, many researches are devoted to substitution of the existing light sources with the LED. The LED is now increasingly used as a light source for lighting devices, for example, various lamps used interiorly and exteriorly, a liquid crystal display device, an electric sign and a street lamp and the like.

SUMMARY

One embodiment is a lighting device. The lighting device comprises: a reflector comprising a reflective part; a heat radiating body comprising a wall disposed around the reflective part of the reflector, wherein the wall comprises a bottom surface and a top surface; a light emitter comprising a substrate disposed on the bottom surface of the wall of the heat radiating body and a plurality of light emitting devices disposed on the substrate; and a cover comprising a reflective surface disposed under the bottom surface and reflecting a first light from the light emitting devices to the reflective part of the reflector, and having an opening emitting a second light from the reflective part of the reflector to outside.

Another embodiment is a lighting device. The lighting device comprises: a heat radiating body comprising a lower part having a first cavity and a upper part having a second cavity; a light emitter comprising a substrate disposed on a bottom surface of the lower part and a plurality of light emitting devices disposed on the substrate; a reflector disposed in the first cavity of the lower part of the heat radiating body; a cover coupled to the lower part of heat radiating body, comprising a reflective surface reflecting a light from the light emitting devices to the reflector; and a power supply controller disposed in the second cavity of the heat radiating body and electrically connected to the light emitter.

Further another embodiment is a lighting device. The lighting device comprises: a light emitter comprising a ring-shaped substrate and a plurality of light emitting devices disposed on the ring-shaped substrate; a heat radiating body having a first cavity and comprising a ring-shaped surface disposed around the first cavity, wherein the ring-shaped substrate is disposed on the ring-shaped surface; a reflector disposed in the first cavity of the first surface of the heat radiating body; and a ring-shaped cover disposed on the plurality of the light emitting devices, comprising a reflective surface to reflect light emitted from the plurality of the light emitting devices to the reflector.

BRIEF DESCRIPTION OF THE DRAWINGS

Arrangements and embodiments may be described in detail with reference to the following drawings in which like reference numerals refer to like elements and wherein.

DETAILED DESCRIPTION

Hereinafter, an embodiment of the present invention will be described in detail with reference to the accompanying drawings.

It will be understood that when an element is referred to as being 'on' or "under" another element, it can be directly on/under the element, and one or more intervening elements may also be present.

Figure 1:
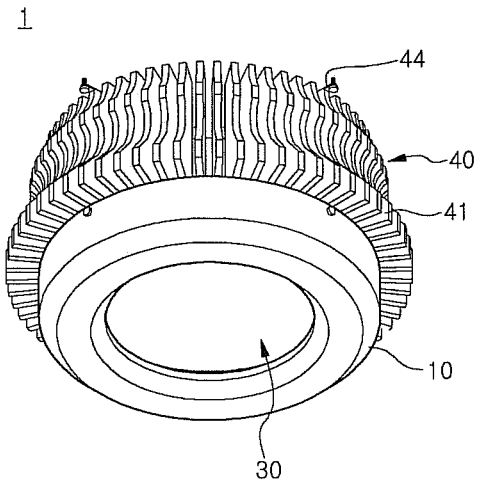
FIG. 1 is a perspective view of a lighting device according to a first embodiment.
Figure 2:
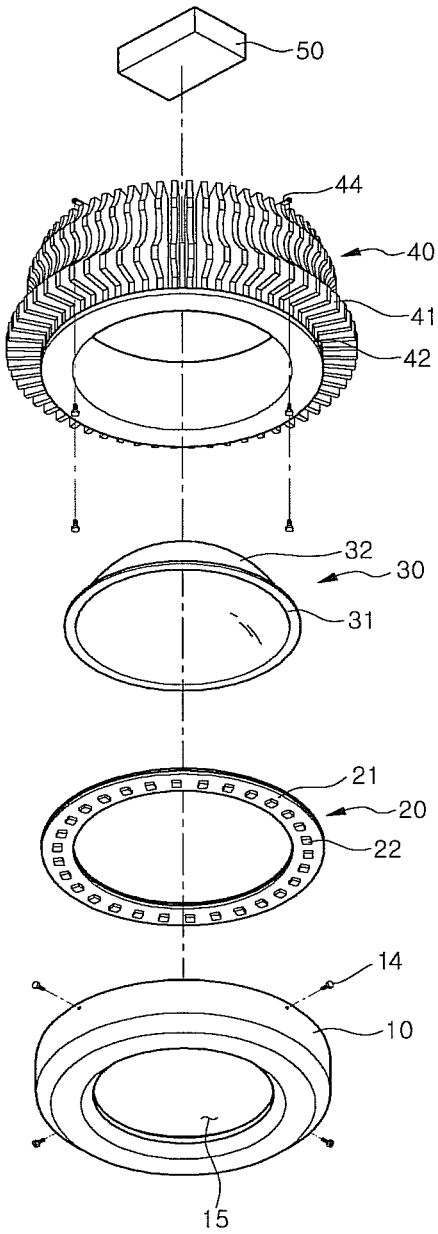
FIG. 2 is an exploded perspective view of the lighting device of FIG. 1.
Figure 3:
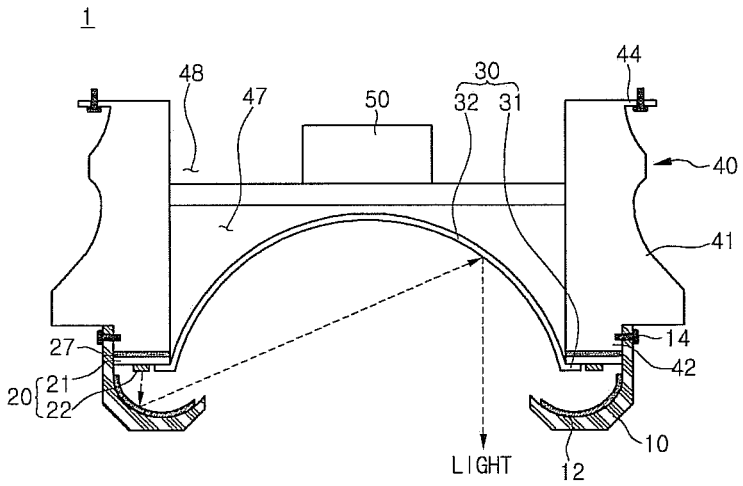
FIG. 3 is a cross sectional view of the lighting device of FIG. 1.

FIG. 1 is a perspective view of a lighting device 1 according to a first embodiment. FIG. 2 is an exploded perspective view of the lighting device 1. FIG. 3 is a cross sectional view of the lighting device 1.

Referring to FIGS. 1 to 3, the lighting device 1 according to the first embodiment includes a heat radiating body 40 including a first receiving groove 47 formed on the bottom surface thereof, a reflective structure 30 disposed in the first receiving groove 47, a light emitting module unit 20 formed in the circumference of the bottom surface of the heat radiating body 40, and a reflective cover 10 being formed under the light emitting module unit 20 and reflecting light emitted from the light emitting module unit 20 to the reflective structure 30.

A second receiving groove 48 may be formed on the top surface of the heat radiating body 40. A power supply controller 50 may be disposed in the second receiving groove 48. The power supply controller 50 is electrically connected to the light emitting module unit 20, thus providing electric power and/or a driving signal to the light emitting module unit 20.

The lighting device 1 according to the first embodiment is attached or coupled to an external support member (not shown) such as a ceiling or a surface of a wall and the like, thus providing light. Here, the light emitted from the light emitting module unit 20 is reflected by the reflective cover 10 and is incident toward the reflective structure 30. The light incident toward the reflective structure 30 is reflected again by the reflective structure 30 and is provided to the outside. That is, the lighting device 1 according to the first embodiment can provide subdued light with reduced glare through the at least two reflections.

The lighting device 1 according to the first embodiment can provide light through the two reflections such that various operations, for example, wavelength variation of the light and photo catalyst reaction, etc., are generated. Detailed description thereabout will be made in detail later.

Hereinafter, the components and operations of the lighting device 1 according to the first embodiment will be described in detail.

The heat radiating body 40 constitutes a body of the lighting device 1 as well as radiates heat generated from the light emitting module unit 20.

The heat radiating body 40 is made of a metallic material or a resin material which has high heat radiation efficiency. However, the material of the heat radiating body 40 is not limited to this. For example, the material of the heat radiating body 40 may include at least one of Al, Ni, Cu, Ag and Sn.

A prominence and depression structure 41 may be formed on the side of the heat radiating body 40 in order to maximize the heat radiation efficiency by enlarging the surface area of the heat radiating body 40. The shape of the prominence and depression structure 41 can be variously changed according to the design of the lighting device 1.

The first receiving groove 47 is formed on the bottom surface of the heat radiating body 40. The second receiving groove 48 is formed on the top surface of the heat radiating body 40. The reflective structure 30 may be inserted and disposed in the first receiving groove 47. The power supply controller 50 may be disposed in the second receiving groove 48. However, the second receiving groove 48 is not necessarily formed.

The shape of the heat radiating body 40 as viewed from the top is not limited to a circle. The heat radiating body 40 may have a polygonal shape, an elliptical shape and the like.

The upper area of the heat radiating body 40 may include a fastening member 44 which can be coupled to an external support member (not shown) such as a ceiling or a surface of a wall and the like. For example, the heat radiating body 40 can be coupled to the external support member (not shown) by inserting a coupling screw into the hole formed in the fastening member 44.

Figure 4:
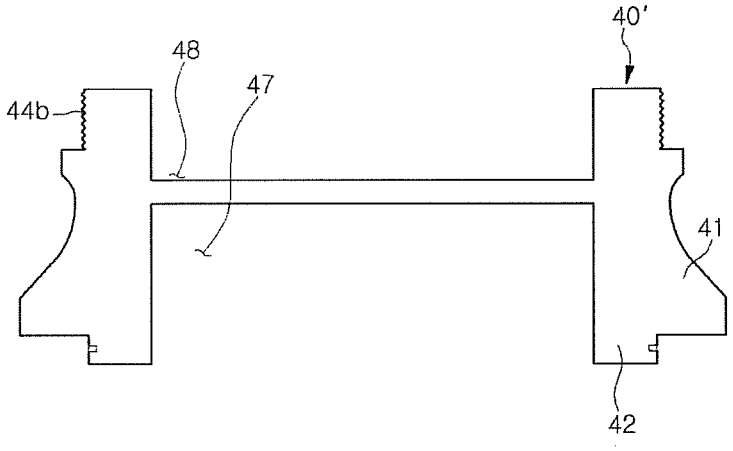
FIG. 4 is a cross sectional view showing another embodiment of a heat radiating body of the lighting device of FIG. 1.

As shown in FIG. 4, a screw groove **44*b* is formed in the upper part of the heat radiating body 40', so that the lighting device 1 may be rotated and fixed to a coupling groove formed in the external support member (not shown). However, there is no limit to the method for attaching or coupling the lighting device 1** to the external support member (not shown).

A level difference portion 42 may be formed in the lower part of the heat radiating body 40 so as to couple the reflective cover 10 to the heat radiating body 40. The reflective cover 10 may be coupled to the level difference portion 42 by means of a coupling screw 14 and the like. However, the method for coupling the reflective cover 10 to the heat radiating body 40 is not limited to this.

The light emitting module unit 20 is formed in the circumference of the bottom surface of the heat radiating body 40. That is, the light emitting module unit 20 is formed outside the first receiving groove 47 of the bottom surface of the heat radiating body 40.

The light emitting module unit 20 may include a substrate 21 and a plurality of light emitting devices 22 mounted on the substrate 21.

The substrate 21 is made by printing a circuit pattern on an insulator. The substrate 21 may include one of a printed circuit board (PCB), a flexible PCB, a metal core PCB, a ceramic PCB and a PCB made of other materials.

The substrate 21 has a shape corresponding to the shape of the heat radiating body 40. As shown in FIGS. 1 and 2, if the shape of the heat radiating body 40 as viewed from the top is a circle, the shape of the substrate 21 may be a circular ring.

Figure 5:
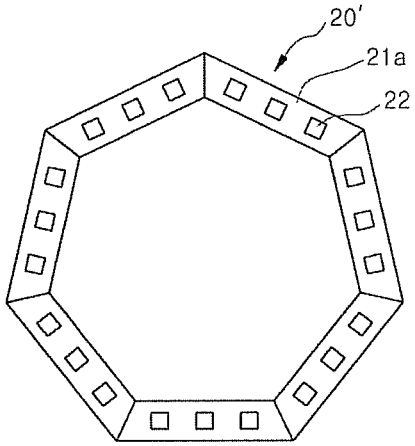
FIG. 5 is a plan view showing another embodiment of a light emitting module unit of the lighting device of FIG. 1.

Meanwhile, when it is difficult to manufacture the circular ring-shaped substrate 21, a plurality of straight line shaped substrates **21*a* of a light emitting module unit 20' are provided and, as shown in FIG. 5, coupled to each other in the form of a polygonal ring close to a circular shape. The shape of the substrate 21*a*** is not limited to this.

Each of the plurality of the light emitting devices 22 may include at least one light emitting diode (hereinafter, referred to as LED). The LED may emit ultraviolet (UV) light, infrared (IR) light and visible light including red light, green light, blue light and white light, etc. However, there is no limit to the number and kind of the light emitted by the LED.

Meanwhile, a heat radiating plate 27 is disposed between the light emitting module unit 20 and the heat radiating body 40. For example, after the heat radiating plate 27 is attached to the circumference of the bottom surface of the heat radiating body 40, the light emitting module unit 20 is attached to the heat radiating plate 27. The heat radiating plate 27 is formed of a thermal conductive tape or a thermal conductive adhesive, etc. The material of the heat radiating plate 27 is not limited to this.

The reflective structure 30 is partially inserted and disposed in the first receiving groove 47 formed on the bottom surface of the heat radiating body 40. The reflective structure 30 reflects the light incident from the reflective cover 10 and provides the light to the outside.

As shown in FIG. 3, the reflective structure 30 includes a hemispherical shape reflective surface 32 and an edge 31 around the reflective surface 32.

For example, the edge 31 is disposed under the substrate 21 of the light emitting module unit 20 and is coupled to the substrate 21 by using an adhesive or a coupling screw. The reflective surface 32 is partially inserted and disposed in the first receiving groove 47.

Meanwhile, the shape of the reflective surface 32 of the reflective structure 30 is not limited to a hemispherical shape. For example, the reflective surface 32 may have a shape of a hemisphere with a depressed vertex, that is, a parabola having a section with two parabolic surfaces. The shape of the reflective surface 32 can be changed according to a design of the lighting device 1.

The material of the reflective structure 30 may include a metallic material or a resin material which has high reflection efficiency or may be formed of the metallic material or the resin material. The metallic material includes, for example, at least one of Ag, an alloy including Ag, Al, an alloy including Al. The resin material includes PET resin, PC resin, PVC resin and the like.

The surface of the reflective structure 30 may be coated with white photo solder resist (PSR), Ag, Al and the like, which have high reflection efficiency.

Otherwise, the first receiving groove 47 is formed to have a reflective surface having a hemispherical shape and the like with high reflection efficiency without formation of the reflective structure 30. The kind of the reflective structure 30 is not limited to this.

The reflective cover 10 is formed under the light emitting module unit 20 and reflects light emitted from the light emitting module unit 20 to the reflective structure 30. The reflective cover 10 may include an opening 15 for allowing the light reflected from the reflective structure 30 to be emitted to the outside.

The inner surface of the reflective cover 10 may be curved such that the light is reflected and emitted to the reflective structure 30 by adjusting the orientation angle of the light emitted from the light emitting module unit 20. The curvature of the curved surface of the inner surface can be variously determined according to the design of the lighting device 1. Meanwhile, the inner surface of the reflective cover 10 may have a polygonal surface. The shape of the inner surface is not limited to this.

As shown in FIG. 3, the reflective cover 10 can be, for example, coupled by means of the coupling screw 14 and the like to the level difference portion 42 formed in the lower part of the heat radiating body 40. However, there is no limit to the method for coupling the reflective cover 10 to the heat radiating body 40.

The reflective cover 10 may include a metallic material or a resin material which has high reflection efficiency or may be formed of the metallic material or the resin material. The metallic material includes, for example, at least one of Ag, an alloy including Ag, Al, an alloy including Al. The resin material includes PET resin, PC resin, PVC resin and the like.

The surface of the reflective cover 10 may be coated with white photo solder resist (PSR), Ag, Al and the like, which have high reflection efficiency.

As such, since the light emitted from the light emitting module unit 20 is reflected by the reflective cover 10 and the reflective structure 30 and is emitted to the outside, the lighting device 1 can provide subdued light with reduced glare.

Meanwhile, at least one of a photo catalytic material 12 or a fluorescent material may be formed on the inner surface of the reflective cover 10. As a result, light emitted from the light emitting module unit 20 is provided performing various functions, such as pollution prevention by the photo catalytic material 12 or/and the fluorescent material formed on the inner surface of the reflective cover 10. Hereinafter, the description thereabout will be made in detailed later.

The photo catalytic material 12 may include, for example, titanium oxide ($TiO_2$). The titanium oxide ($TiO_2$) oxides, decomposes and removes impurities by causing a chemical reaction by means of light with an ultra violet wavelength or a blue wavelength of about 200 nm to 450 nm.

In other words, the photo catalytic material 12 is formed on the inner surface of the reflective cover 10 and prevents the reflective cover 10 from being polluted by impurities, so that the light intensity of the lighting device 1 can be maintained.

The plurality of the light emitting devices 22 of the light emitting module unit 20 emit light with an ultra violet wavelength by which the titanium oxide ($TiO_2$) causes a chemical reaction, or emit light with a blue wavelength of about 200 nm to 450 nm. Here, when the titanium oxide ($TiO_2$) is used as the photo catalytic material 12, it is desirable that at least one portion of the plurality of the light emitting devices 22 is used.

The photo catalytic material 12 may be coated or spray-coated on the inner surface of the reflective cover 10 in the form of a thin film. However, there is no limit to the method for forming the photo catalytic material 12.

The fluorescent material is excited by a first light emitted from the light emitting module unit 20, thus generating a second light. Accordingly, light mixed with the first light and the second light is generated by the fluorescent material. As a result, the wavelength of the light provided by the lighting device 1 can be changed.

The fluorescent material is included in a resin material or a silicon material and is formed on the inner surface of the reflective cover 10 by using a coating method and the like. On the other hand, a phosphor luminescent film (PLF) including the fluorescent material is provided, and then the phosphor luminescent film (PLF) may be attached to the inner surface of the reflective cover 10. There is no limit to a method for forming the fluorescent material.

The power supply controller 50 is disposed in the second receiving groove 48 of the top surface of the heat radiating body 40.

The power supply controller 50 receives electric power from an external power supply and converts the electric power into electric power of a type suitable for the light emitting module unit 20 and then transmits. For example, the power supply controller 50 may be formed to include at least one selected from a group consisting of a direct current-direct current converter converting alternating current into direct current, a protective device for protecting an electro static discharge (ESD) of the light emitting module unit 20, a driving chip for controlling and driving the light emitting module unit 20, and a micro processor and the like.

While not shown, the power supply controller 50 can be electrically connected to the light emitting module unit 20 through a wiring. For example, a through hole is formed to pass through the top surface and the bottom surface of the heat radiating body 40, and then the wiring is capable of connecting the light emitting module unit 20 to the power supply controller 50 through the through hole.

Hereinafter, a lighting device 1B according to a second embodiment will be described in detail. However, in description of the second embodiment, repetitive descriptions of the first embodiment will be omitted or briefly described.

Figure 6:
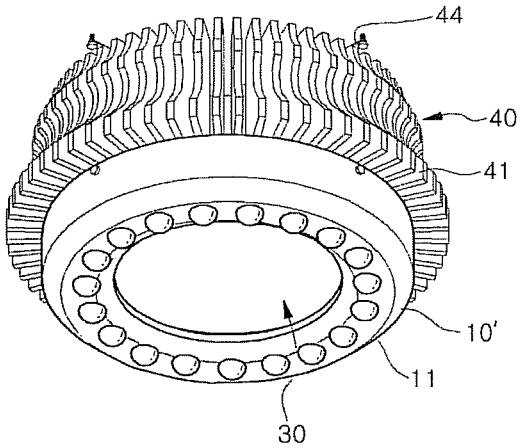
FIG. 6 is a perspective view of a lighting device according to a second embodiment.
Figure 7:
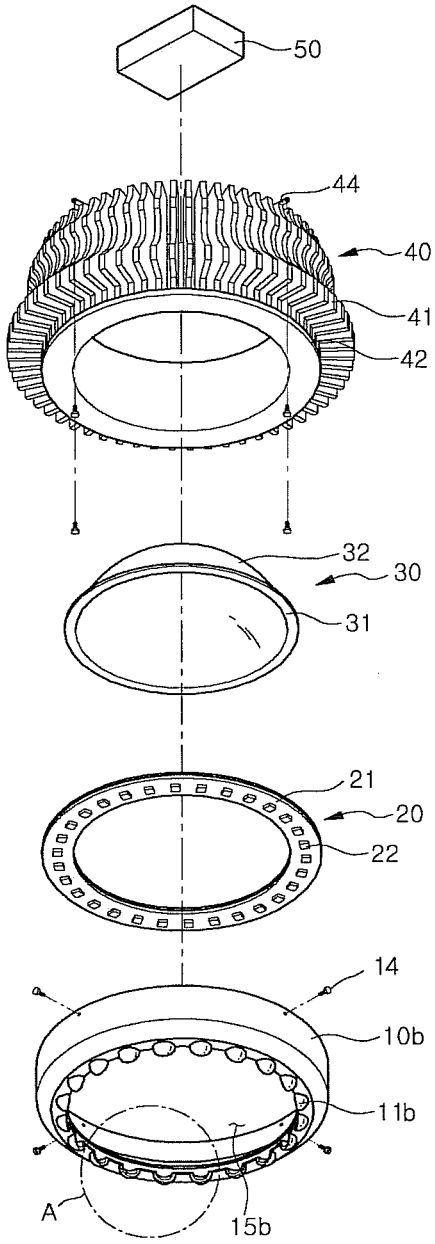
FIG. 7 is an exploded perspective view of the lighting device of FIG. 6.
Figure 8:
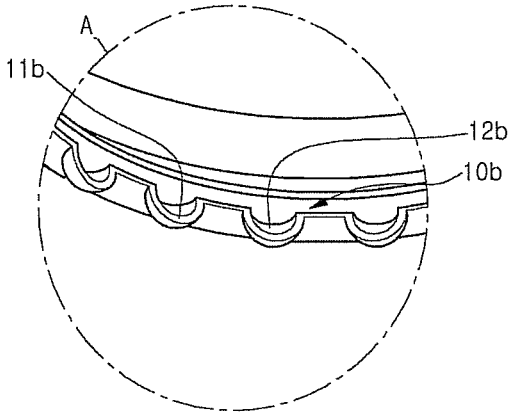
FIG. 8 is a view showing an enlarged area denoted by "A" of FIG. 7.

FIG. 6 is a perspective view of a lighting device 1B according to a second embodiment. FIG. 7 is an exploded perspective view of the lighting device 1B of FIG. 6. FIG. 8 is a view showing an enlarged area denoted by "A" of FIG. 7.

Referring to FIGS. 6 to 8, the lighting device 1B includes a heat radiating body 40 including a first receiving groove 47 formed on the bottom surface thereof, a reflective structure 30 being disposed in the first receiving groove 47 and reflecting incident light to the outside, a light emitting module unit 20 formed in the circumference of the bottom surface of the heat radiating body 40, and a reflective cover 10' being formed under the light emitting module unit 20 and including a plurality of lenses 11*b* reflecting light emitted from the light emitting module unit 20 to the reflective structure 30.

The lighting device 1B according to the second embodiment is similar to the lighting device 1 according to the first embodiment, except the shape of the reflective cover 10*b*.

The reflective cover 10*b* may have a circular shape or a polygonal ring shape. The inner surface of the reflective cover 10*b* includes a plurality of concave surfaces. The plurality of the concave surfaces are radially arranged at a regular interval on the inner surface of the reflective cover 10*b*. At least one the concave surface is required. The concave surface may have a constant curvature or a polygonal surface. The concave surface performs a function of collecting substantially light emitted from the light emitting module unit in a particular direction.

Therefore, in the embodiment, the concave surface is designated as a lens 11*b*.

The plurality of the lenses 11*b* may have shapes capable of effectively reflecting light incident from the light emitting module unit 20 to the reflective structure 30, for example, a shape of a hemisphere having a cut part. There is no limit to the shape of the lens 11*b*.

The plurality of the lenses 11*b* of the reflective cover 10*b* may be formed to correspond to the plurality of the light emitting devices 22 of the light emitting module unit 20. The plurality of the lenses 11*b* can be hereby designed such that light emitted from each of the plurality of the light emitting devices 22 proceeds to the reflective structure 30.

Here, the plurality of the lenses 11*b* may have a one-to-one correspondence or one-to-many correspondence with the plurality of the light emitting devices 22. Meanwhile, a correspondence ratio between the plurality of the lenses 11*b* and the plurality of the light emitting devices 22 may be changed according to a lighting provided by the lighting device 1B. There is no limit to the correspondence ratio.

Particularly, when the plurality of the light emitting devices 22 emit light having many colors, it is required that the plurality of the lenses 11*b* should have a one-to-many correspondence with the plurality of the light emitting devices 22.

For example, light emitting devices emitting red light, green light and blue light respectively may correspond to one lens 11*b*. Otherwise, a light emitting device emitting visible light and a following light emitting device emitting ultraviolet light capable of reacting with a photo catalytic material may correspond to one lens 11*b*. There is no limit to the method of correspondence between the light emitting devices and the lens 11*b*.

Figure 9:
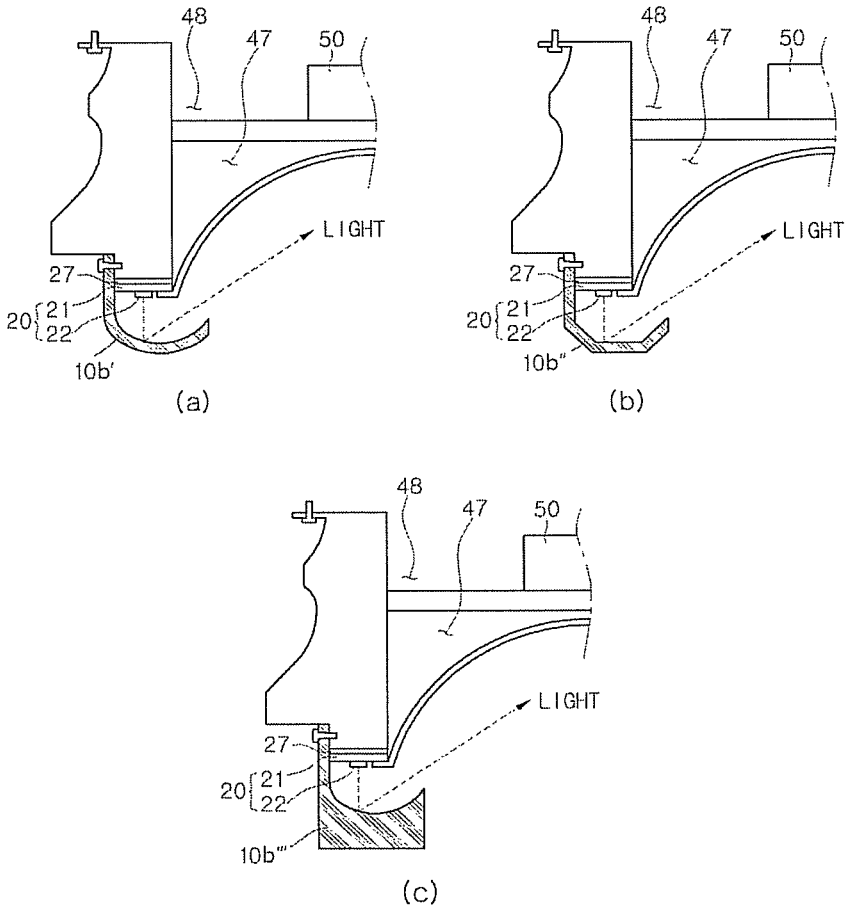
FIG. 9 is a view showing various examples of a reflective cover of the lighting device of FIG. 6.

FIG. 9 is a view showing various examples of the shape of the reflective cover 10*b* including the plurality of the lenses 11*b*.

Referring to (a) of FIG. 9, the inner surface and outer surface of the reflective cover 10*b*' may be curved. Referring to (b) of FIG. 9, the inner surface and outer surface of the reflective cover 10*b*" may have a polygonal surface. Referring to (c) of FIG. 9, the inner surface of the reflective cover 10*b*'" may be curved and the outer surface of the reflective cover 10*b* may be flat.

That is, the shape of the reflective cover 10*b*', 10*b*", 10*b*'" including the plurality of the lenses 11*b* can be variously changed according to the design of the lighting device 1B. There is no limit to the shape of the reflective cover 10*b*', 10*b*", 10*b*'".

Referring to FIGS. 6 to 8 again, at least one of a photo catalytic material 12*b* and a fluorescent material may be formed on the inner surfaces of the plurality of the lenses 11*b*. The photo catalytic material 12*b* reacts with light emitted from the light emitting module unit 20 and decomposes impurities, and then hereby prevents the reflective cover 10*b* from being polluted and maintains the light intensity of the lighting device 1B. The fluorescent material is excited by a first light emitted from the light emitting module unit 20, thus generating a second light. Accordingly, the lighting device 1B can provide light with a wavelength changed by mixing the first light with the second light.

While not shown, a separate cover may be further formed under the reflective cover 10*b* in order to protect the reflective cover 10*b* which includes the plurality of the lenses 11*b*. Here, there is no limit to the separate cover.

Hereinafter, a lighting device 1C according to a third embodiment will be described in detail. However, in description of the third embodiment, repetitive descriptions of the first embodiment will be omitted or briefly described.

Figure 10:
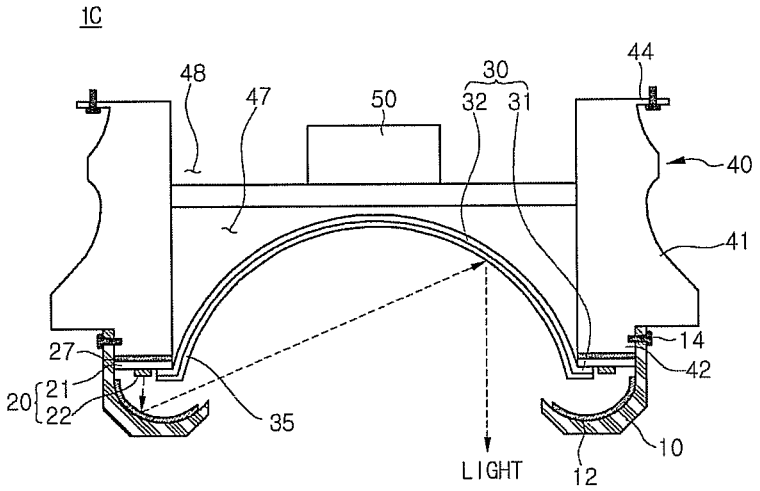
FIG. 10 is a cross sectional view of a lighting device according to a third embodiment.

FIG. 10 is a cross sectional view of a lighting device 1C according to a third embodiment.

Referring to FIG. 10, the lighting device 1C includes a heat radiating body 40 including a first receiving groove 47 formed on the bottom surface thereof, a reflective structure 30 being disposed in the first receiving groove 47 and reflecting incident light to the outside and including a phosphor luminescent film (PLF) 35 in the inner surface thereof, a light emitting module unit 20 formed in the circumference of the bottom surface of the heat radiating body 40, and a reflective cover 10 being formed under the light emitting module unit 20 and reflecting light emitted from the light emitting module unit 20 to the reflective structure 30.

The lighting device 1C according to the third embodiment is the same as the lighting device 1 according to the first embodiment, except the existence of the phosphor luminescent film (PLF) 35 on the inner surface of the reflective structure 30.

The phosphor luminescent film (PLF) 35 is a silicon or resin-made thin film including a fluorescent material. The fluorescent material is excited by a first light incident on the reflective structure 30 and generates a second light. The reflective structure 30 can emit light mixed with the first light and the second light.

That is, the wavelength of the light incident from the reflective cover 10 may be changed by the phosphor luminescent film (PLF) 35 attached to the inner surface of the reflective structure 30. As a result, the lighting device 1C can display various color senses.

Meanwhile, in the third embodiment, while the reflective structure 30 and the phosphor luminescent film (PLF) 35 are separately arranged, the reflective structure 30 may have a phosphor luminescent function of its own instead of disposing a separate phosphor luminescent film (PLF) on the inner surface of the reflective structure 30. That is, in the embodiment, it is possible to substitute the reflective structure 30 with a phosphor luminescent plate having a shape of a flat plate made of a hard material, instead of the phosphor luminescent film (PLF) 35. Accordingly, light emitted from the light emitting module unit 20 is reflected by the reflective cover 10 and is incident on the reflective structure 30, and then the incident light is reflected again and is emitted to the outside. Here, the light incident from the reflective cover 10 has a changed wavelength and is emitted to the outside.

Hereinafter, a lighting device 1D according to a fourth embodiment will be described in detail. However, in description of the fourth embodiment, repetitive descriptions of the first embodiment will be omitted or briefly described.

Figure 11:
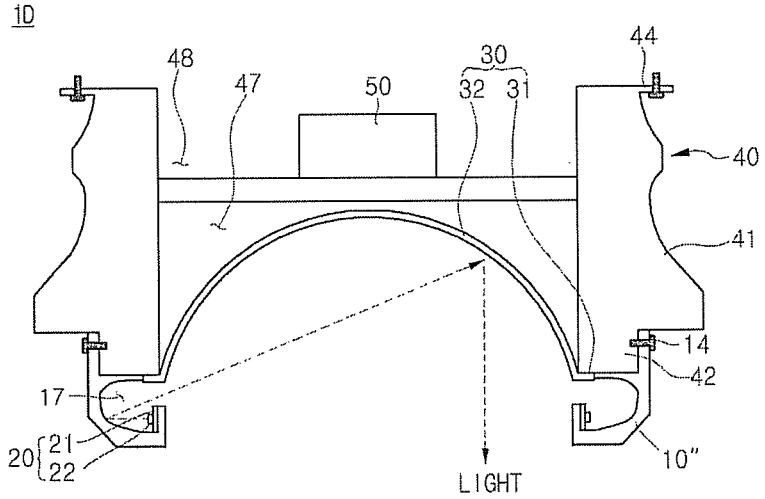
FIG. 11 is a cross sectional view of a lighting device according to a fourth embodiment.

FIG. 11 is a cross sectional view of a lighting device 1D according to a fourth embodiment.

Referring to FIG. 11, the lighting device 1D includes a heat radiating body 40 including a first receiving groove 47 formed on the bottom surface thereof, a reflective structure 30 disposed in the first receiving groove 47, a reflective cover 10" being formed in the circumference of the bottom surface of the heat radiating body 40 and including an inner groove 17 thereinside, and a light emitting module unit 20 being disposed inside the inner groove 17 of the reflective cover 10" and emitting light to the side wall of the inner groove 17.

The lighting device 1D according to the fourth embodiment is the same as the lighting device 1 according to the first embodiment, except the shape of the reflective cover 10" and a position in which the light emitting module unit 20 is formed.

The reflective cover 10" includes the inner groove 17 thereinside. The light emitting module unit 20 is formed in the lower part of the inner groove 17. Here, the light emitting module unit 20 emits light to the side wall of the inner groove 17. Then, the light reflected by the side wall can be incident on the reflective structure 30.

That is, the light emitting module unit 20 of the lighting device 1D can have the same effect as that of the first embodiment by emitting light in the side direction instead of emitting the light downward as described in the first embodiment.

The features, structures and effects and the like described in the embodiments are included in at least one embodiment of the present invention and are not necessarily limited to one embodiment. Furthermore, the features, structures, effects and the like provided in each embodiment can be combined or modified in other embodiments by those skilled in the art to which the embodiments belong. Therefore, contents related to the combination and modification should be construed to be included in the scope of the present invention.

Although embodiments of the present invention were described above, theses are just examples and do not limit the present invention. Further, the present invention may be changed and modified in various ways, without departing from the essential features of the present invention, by those skilled in the art. For example, the components described in detail in the embodiments of the present invention may be modified. Further, differences due to the modification and application should be construed as being included in the scope and spirit of the present invention, which is described in the accompanying claims.

What is claimed is:

1. A lighting device comprising:

a reflector comprising a reflective part;

a heat radiating body comprising a wall disposed around the reflective part of the reflector, wherein the wall comprises a bottom surface and a top surface;

a light emitter comprising a substrate disposed on the bottom surface of the wall of the heat radiating body and a plurality of light emitting devices disposed on the substrate; and a cover comprising a reflective surface disposed under the bottom surface and reflecting a first light from the light emitting devices to the reflective part of the reflector, and having an opening emitting a second light from the reflective part of the reflector to outside.

2. The lighting device of claim 1, wherein the reflective surface of the cover is smaller than a reflective surface of the reflective part.

3. The lighting device of claim 1, wherein a diameter of the opening of the cover is smaller than a maximum diameter of the reflective part of the reflector.

4. The lighting device of claim 1, wherein the wall of the heat radiating body comprises a prominence and depression structure.

5. The lighting device of claim 1, wherein the cover further comprises a photo catalytic material disposed on the reflective surface.

6. The lighting device of claim 1, wherein the heat radiating body further comprises a cavity in which the reflective part of the reflector is disposed, wherein the reflector further comprises an edge part coupled to the substrate.

7. The lighting device of claim 6, wherein a shape of the cavity is different from a shape of the reflective part of the reflector.

8. A lighting device comprising:

a heat radiating body comprising a lower part having a first cavity and a upper part having a second cavity;

a light emitter comprising a substrate disposed on a bottom surface of the lower part and a plurality of light emitting devices disposed on the substrate;

a reflector disposed in the first cavity of the lower part of the heat radiating body;

a cover coupled to the lower part of heat radiating body, comprising a reflective surface reflecting a light from the light emitting devices to the reflector; and a power supply controller disposed in the second cavity of the heat radiating body and electrically connected to the light emitter.

9. The lighting device of claim 8, wherein the upper part of the heat radiating body comprises a fastening member being coupled to an external support member.

10. The lighting device of claim 8, wherein the upper part of the heat radiating body comprises a screw groove being rotated and fixed to a coupling groove formed in an external support member.

11. The lighting device of claim 8, wherein the first cavity is greater than the second cavity.

12. The lighting device of claim 8, wherein the reflector comprises a reflective part disposed in the first cavity and an edge part coupled to the substrate of the light emitter.

13. The lighting device of claim 8, wherein the heat radiating body comprises a prominence and depression structure.

14. The lighting device of claim 8, wherein the cover further comprises a photo catalytic material disposed on the reflective surface.

15. A lighting device comprising:

a light emitter comprising a ring-shaped substrate and a plurality of light emitting devices disposed on the ring-shaped substrate;

a heat radiating body having a first cavity and comprising a ring-shaped surface disposed around the first cavity, wherein the ring-shaped substrate is disposed on the ring-shaped surface;

a reflector disposed in the first cavity of the first surface of the heat radiating body; and a ring-shaped cover disposed on the plurality of the light emitting devices, comprising a reflective surface to reflect light emitted from the plurality of the light emitting devices to the reflector.

16. The lighting device of claim 15, wherein the ring-shaped substrate comprises a plurality of straight line shaped substrates coupled to each other.

17. The lighting device of claim 15, wherein the reflector comprises a hemisphere reflective part disposed in the first cavity and a ring-shaped edge part coupled to the ring-shaped substrate of the light emitter.

18. The lighting device of claim 15, wherein the ring-shaped substrate has a first opening, wherein the ring-shaped cover has a second opening, and wherein a diameter of the second opening is smaller than a diameter of the first opening.

19. The lighting device of claim 15, wherein the heat radiating body comprises a prominence and depression structure.

20. The lighting device of claim 15, wherein the ring-shaped cover further comprises a photo catalytic material disposed on the reflective surface.

* * * * *